US011812853B2

(12) United States Patent
Sollie et al.

(10) Patent No.: US 11,812,853 B2
(45) Date of Patent: Nov. 14, 2023

(54) TILT LOCKING DEVICE

(71) Applicant: Flokk AB, Nässjö (SE)

(72) Inventors: Marius Sollie, Oslo (NO); Torstein Mørch Knutzen, Oslo (NO)

(73) Assignee: Flokk AB, Nässjö (SE)

( * ) Notice: Subject to any disclaimer, the term of this patent is extended or adjusted under 35 U.S.C. 154(b) by 129 days.

(21) Appl. No.: 17/423,717

(22) PCT Filed: Jan. 18, 2019

(86) PCT No.: PCT/EP2019/051289
§ 371 (c)(1),
(2) Date: Jul. 16, 2021

(87) PCT Pub. No.: WO2020/147973
PCT Pub. Date: Jul. 23, 2020

(65) Prior Publication Data

US 2022/0142369 A1 May 12, 2022

(51) Int. Cl.
*A47C 1/026* (2006.01)
*A47C 1/032* (2006.01)
(Continued)

(52) U.S. Cl.
CPC ..... *A47C 1/026* (2013.01); *A47C 1/03272* (2013.01); *A47C 3/026* (2013.01);
(Continued)

(58) Field of Classification Search
CPC ..... A47C 3/026; A47C 7/004; A47C 1/03272; A47C 7/44; A47C 7/443; A47C 1/026; A47C 3/03
(Continued)

(56) References Cited

U.S. PATENT DOCUMENTS 1,238,035 A 8/1917 Mcerlane
2,307,621 A 1/1943 Dorton
(Continued)

FOREIGN PATENT DOCUMENTS

CN 101228044 A 7/2008
CN 101296636 A 10/2008
(Continued)

OTHER PUBLICATIONS

PCT/EP2019/051289; International Search Report and Written Opinion; dated Jun. 27, 2019; 13 pages.
(Continued)

*Primary Examiner* — Robert Canfield
(74) *Attorney, Agent, or Firm* — Kilpatrick Townsend & Stockton LLP

(57) ABSTRACT

A tilt locking device for a chair, comprising a housing configured for connection to one of a seat and a frame; a first rotatable locking member, rotatable about a first axis and biased in a first direction about the first axis, the first rotatable locking member is configured for interlocking with a notch member; a rotatable activation member, rotatable about a second axis, the rotatable activation member is configured to abut and rotate the first rotatable locking member in a second direction opposite the first direction into interlocking with the notch member.

11 Claims, 4 Drawing Sheets

(51) Int. Cl.

| | |
|---|---|
| ***A47C 3/026*** | (2006.01) |
| ***A47C 3/03*** | (2006.01) |
| ***A47C 7/44*** | (2006.01) |
| ***A47C 7/00*** | (2006.01) |

(52) U.S. Cl.
CPC ..... *A47C 3/03* (2013.01); *A47C 7/004* (2013.01); *A47C 7/44* (2013.01); *A47C 7/443* (2013.01)

(58) Field of Classification Search
USPC ..... 297/300.5–300.8, 302.4–302.8
See application file for complete search history.

(56) References Cited

U.S. PATENT DOCUMENTS 4,372,611 A * 2/1983 Feddeler ..... A47C 1/026 297/371
10,813,458 B2 * 10/2020 Moreschi ..... A47C 7/58
2004/0195881 A1 * 10/2004 Wells ..... A47C 1/03255 297/262.1
2009/0066134 A1 * 3/2009 Bock ..... A47C 1/024 297/301.3
2012/0032484 A1 * 2/2012 Cvek ..... A47C 1/0242 297/354.1

FOREIGN PATENT DOCUMENTS

| | | | | |
|---|---|---|---|---|
| CN | 101686761 | A | | 3/2010 |
| CN | 101849748 | A | | 10/2010 |
| CN | 107625324 | A | | 1/2018 |
| JP | 2003009980 | A | * | 1/2003 |

OTHER PUBLICATIONS

PCT/EP2019/051289; Second Written Opinion; dated Oct. 20, 2020; 4 pages.
Application No. CN201980089241.9, Office Action, dated Sep. 1, 2023, 8 pages.

* cited by examiner

TILT LOCKING DEVICE

The invention relates to a tilt locking device, and more specifically to a tilt locking device for a chair seat, as set out herein.

BACKGROUND

Mechanisms and devices for adjusting the tilting of a chair seat allow the chair seat to be tilted and locked in a position relative to a frame or base of the chair, such that users may individually adjust the angle of the seat according to their preferences. Generally, a seat that is tilted such that the back portion of the seat is elevated tends to provide for a more active sitting posture, while a seat that is tilted such that the front portion of the seat is elevated tends to provide for a more relaxed sitting posture.

When a user rests on a chair seat, the tilt locking device is subject to great strain, and a tilt locking device must thus be strong and durable. Common tilt locking devices comprise a notch member with notches, where the seat can be locked at different angles due to a locking member that is configured to be interlocked in one of the notches. However, such systems are generally not very compact, and because of limited space available in many chairs today, it is often difficult to fit such a tilt locking device into e.g. a slim office chair. Also, tilt locking devices often comprises several parts that complicate assembly of the chair and thus increases production cost.

A common tilt locking device comprising notches is very durable, however, there are a limited the number of notches, and a user may feel that the seat is not locked into the exact tilting position as the user desires. Many users are also accustomed to a higher resolution of adjusting, or even ungraded adjusting, in other products. Unfortunately, tilting devices with a higher resolution of adjusting may not be as rigid and long-lasting as those comprising notches.

U.S. Pat. No. 2,307,621 A describes an adjustable chair where the back may be swung downward through pressure exerted thereon by the occupant, and which will automatically swing upward when relieved of such pressure.

There is therefore a need for an improved tilt locking device to reduce or eliminate the above mentioned disadvantages of known techniques. It is an objective of the present invention to achieve this and to provide further advantages over the state of the art.

SUMMARY

In an embodiment, there is provided a tilt locking device for a chair, comprising a housing configured for connection to one of a seat and a frame, a first rotatable locking member rotatable about a first axis and biased in a first direction about the first axis in a direction away from a notch member. The first rotatable locking member is configured for interlocking with the notch member. A second rotatable locking member is rotatable about the first axis independently of the first rotatable locking member and biased in the first direction about the first axis. An intermediate member biases the first and second rotatable locking members in the first direction, the intermediate member is biased in the first direction by an intermediate member spring. The tiltlocking device further comprises a rotatable activation member, rotatable about a second axis. The rotatable activation member is configured to abut and rotate the first and second rotatable locking members in a second direction opposite the first direction into interlocking one of the first and second rotatable locking members with the notch member. The rotatable activation member comprises an activation member spring for resiliently abutting and rotating the first and second locking members, the biasing force of the activation member spring exceeds the biasing force of the intermediate member spring such that when the rotatable activation member is rotated in a first direction about the second axis into abutment with the rotatable locking members, the rotatable locking members are rotated in the second direction about the first axis. This can provide for a compact design of the tilt locking device.

According to another embodiment of the invention, the first and second rotatable locking members are connected by an intermediate member rotatable about the first axis and limiting individual rotation of the first and second rotatable locking members. The intermediate member can provide for a compact design.

According to another embodiment of the invention, the first and second axes are rods connected to the housing. The tilt locking device is can thus be a compact piece that is easy to assemble together with the rest of the chair.

According to another embodiment of the invention, the rotatable activation member is controlled by an activation rod. The activation rod can provide for easy controlling of the tilt locking device.

According to another embodiment of the invention, the rotatable activation member comprises an activation groove configured for accommodating an activation rod.

The activation groove can provide for easy controlling and secure locking of the tilt locking device.

According to another embodiment of the invention, the first and second rotatable locking members comprise a lock element for interconnection with a notch of the notch member. A locking element such as a cylindrical element can provide for a smooth interconnection between the at least one rotatable locking member and a notch.

In an embodiment, there is provided a notch member configured for connection to one of a seat and a frame of a chair. The notch member comprises a first row and a second row of notches arranged side-by-side.

According to another embodiment of the invention, the first and second row of notches are arranged equidistant.

According to another embodiment of the invention, the notches of the first and second row are not aligned.

According to another embodiment of the invention, the notches of the first and second row are arranged alternately along the rows.

In an embodiment, there is provided a tilt locking assembly for a chair, comprising a tilt locking device and a notch member.

According to another embodiment of the invention, the tilt locking assembly is controlled by a handle connected to an activation rod.

BRIEF DESCRIPTION OF THE DRAWINGS

The above and other characteristics will become clear from the following description of embodiments, given as non-restrictive examples, with reference to the attached schematic figures.

DETAILED DESCRIPTION

The following description may use terms such as "horizontal", "vertical", "lateral", "upper", "lower", "inner", "outer", "forward", "rear", etc. These terms generally refer to the views and orientations as shown in the figures and that are associated with a normal use of the invention. The terms are used for the reader's convenience only and shall not be limiting.

Figure 1:
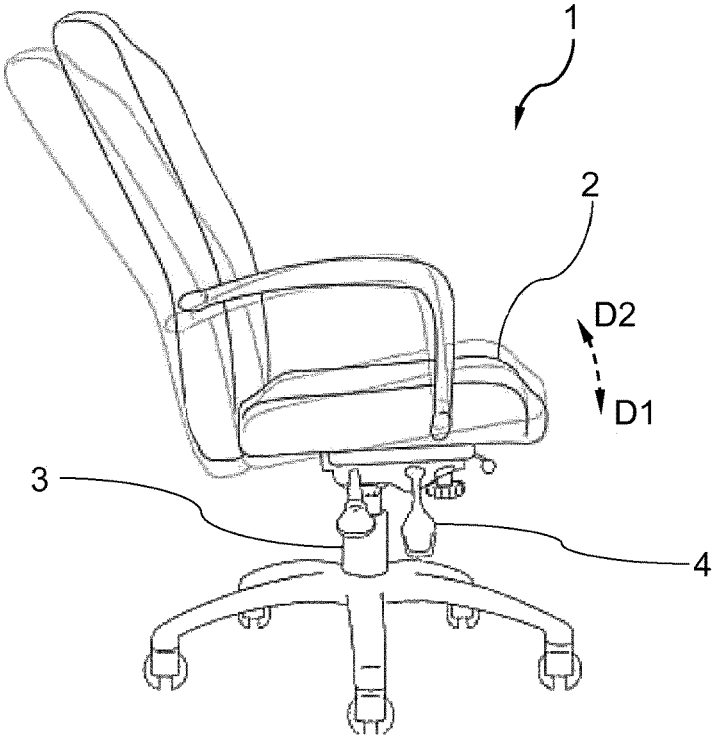
FIG. 1 is a side view of a chair comprising a seat and a frame.

Referring initially to FIG. 1, a chair 1 comprising a seat 2 and a frame 3 is illustrated. The chair 1 also comprises a tilt locking device (not visible in the FIG. which in an open position allows the chair seat 2 to be tilted down and up, i.e. in a direction with the clock D1 or towards the clock D2 in FIG. 1. In a locked position the tilt locking device secures the seat 2 at a desired tilting angle. If a back and arm rests are connected to the seat 2, these also follow the tilting movement of the seat 2, as also illustrated in FIG. 1. A handle 4 that is controlled by a user of the chair may activate the tilt locking device from an open position to a locked position and vice versa, and when the seat 3 has been tilted to the desired tilting angle, the tilt locking device is activated and locked by the handle 4.

The chair 1 may also comprise a spring mechanism (not illustrated in the figure) or other biasing means that biases the seat 2, and commonly also the back and armrests connected to the seat 2, in the direction D1 in FIG. 1. When a user by means of the handle 4 brings the tilt locking device into an unlocked state, this spring may force the seat 2 downwards, i.e. in direction D1. The tilting of the seat 2 is thus easy for a user to control. When the user leans forwards, the seat 2 in FIG. 1 rotates in direction D1 and follows the movement of the user without the user needing to apply a force to the seat 2 in order to make it tilt because the seat 2 is biased by the spring mechanism. When the tilt locking device is in the unlocked state and the user leans backwards, the weight of the user exceeds the force from the spring mechanism, and the seat 2 can be tilted in the direction D2 exclusively by the weight and motion of the user. A spring mechanism for assisting the tilting of a chair seat is known in the art.

Figure 2:
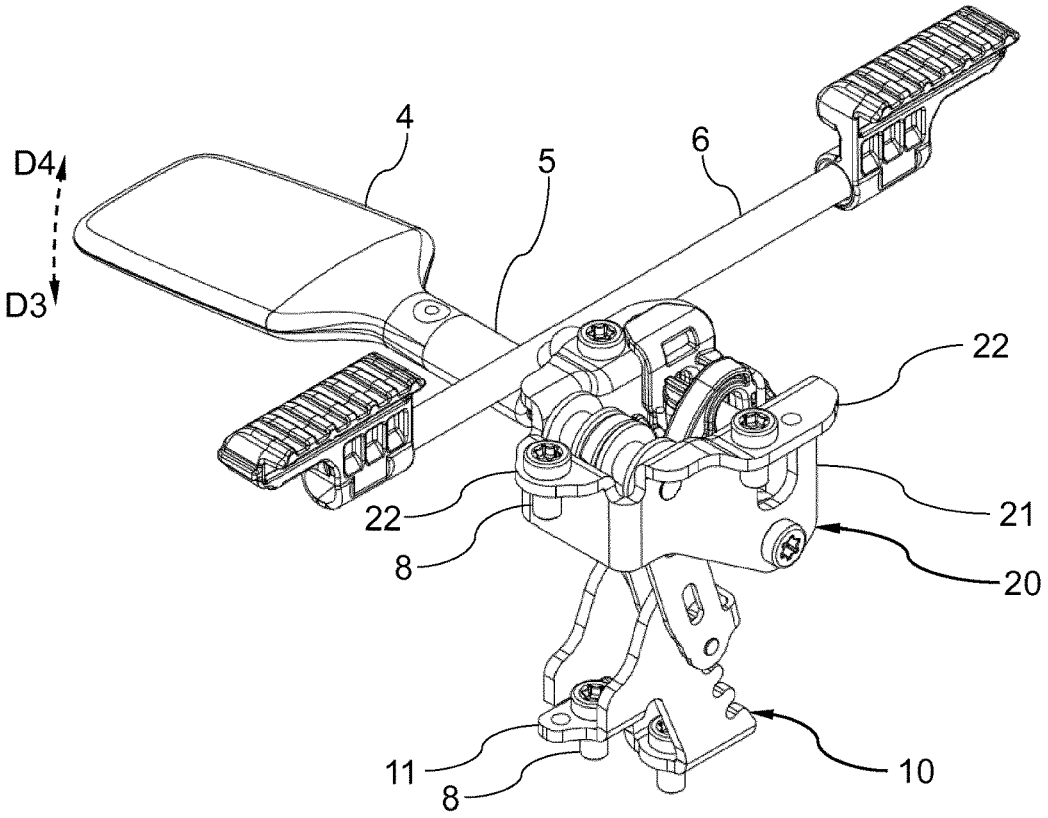
FIG. 2 is a perspective view of an activation rod, a tilt locking device and a notch member.

FIG. 2 illustrates the handle 4, a notch member 10 and a tilt locking device 20. The handle 4 is connected to an activation rod 5. The activation rod 5 extends from the handle 4 into the tilt locking device 20. In the illustrated embodiment, the activation rod 5 is connected to and can pivot about a pivot axle 6. The pivot axle 6 may be resting on bearings at either end, or the activation rod 5 may be pivotably connected to the pivot axle 6. The activation rod 5 could also be arranged and connected to the tilt locking device 20 by other means.

In the illustrated embodiment, the handle 4 and tilt locking device 20 are positioned on opposing sides of the pivot axle 6, such that when the handle 4 is moved in a downwards direction, indicated by arrow D3 in FIG. 2, the activation rod 5 extending into the tilt locking device 20 is moved in an upwards direction inside the tilt locking device 20. Correspondingly, an upwards movement D4 of the handle 4 results in a downwards movement of the activation rod 5 in the locking device 20.

Alternatively, the activation rod 5 may be arranged and connected to the tilt locking device 20 such that a movement of the handle 4 and activation rod 5 in one direction results in a movement in a corresponding direction for the activation rod 5 in the tilt locking device 20.

The notch member 10 is configured for connection to one of a seat and a frame (not illustrated in FIG. 2, see FIG. 1). The notch member 10 is in the illustrated embodiment fastened to the frame, and may be secured to the frame by fastening means 8 such as screws. The notch member 10 may comprise flanges 11 where the fastening means 8 are positioned, for securing a rigid connection to e.g. a frame.

The tilt locking device 20 comprises a housing 21. The housing 21 is configured for connection to one of a seat and a frame, and may also be an integrated portion of the seat or the frame. The housing 21 is in the illustrated embodiment a separate part that is fastened to the seat, and may be secured to e.g. the seat by fastening means 8 such as screws. The housing 21 may comprise flanges 22 where the fastening means 8 are positioned, for securing a rigid connection to e.g. the seat. The housing 21 in the illustrated embodiment comprises three flanges 22.

The seat and frame are preferably hingedly connected together on some other location on the chair (not shown in the figures), such that when the tilt locking device 20 is in an open state and not locked to the notch member 10, the chair seat can be tilted about this hinged connection. This connection may also limit the minimum and maximum tilting of the chair seat.

Figure 3:
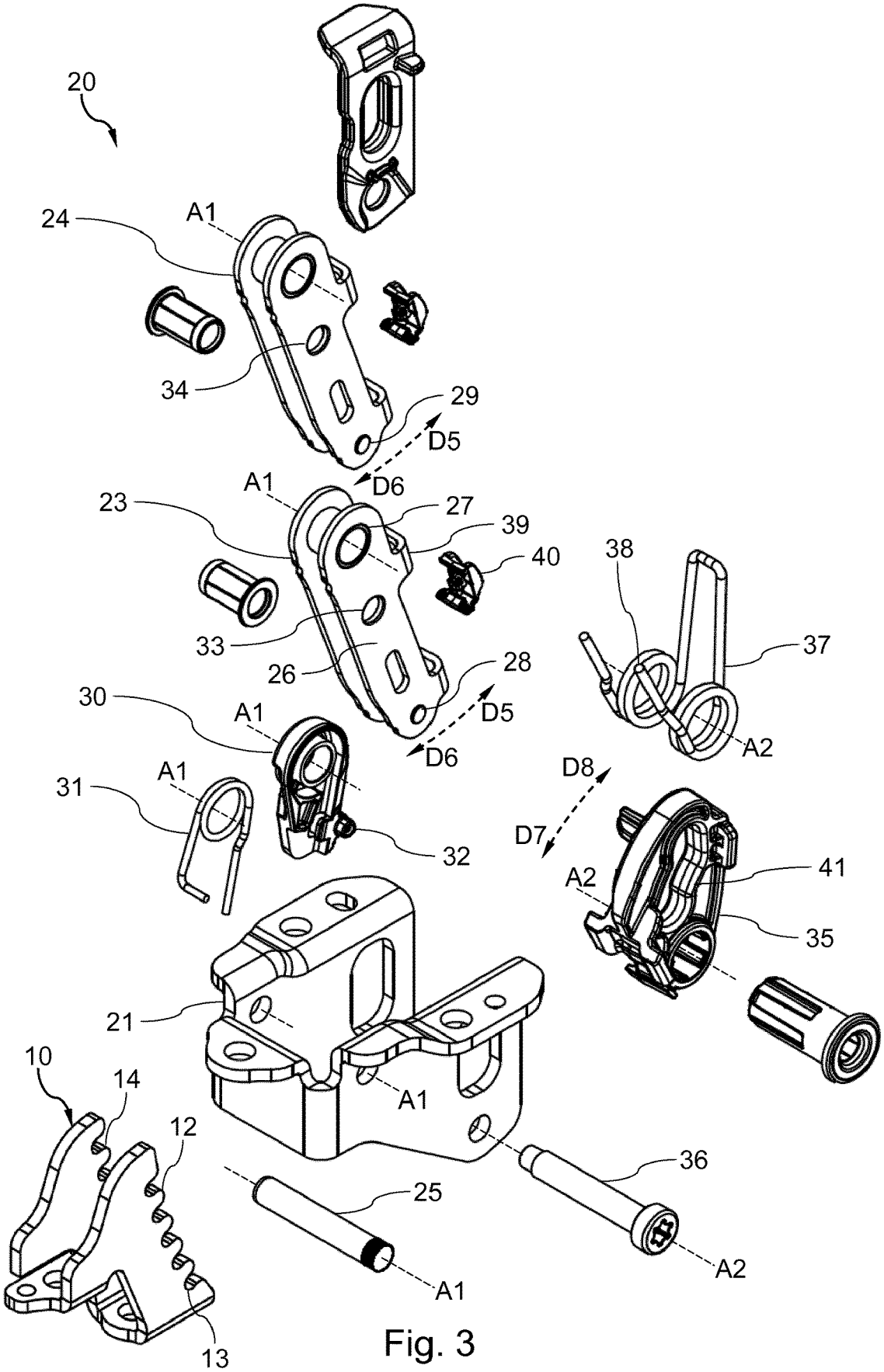
FIG. 3 is an exploded view illustrating various members of the tilt locking device and the notch member.

FIG. 3 is an exploded view of an embodiment of the tilt locking device 20 and the notch member 10. The notch member 10 may preferably be made of metal, and more preferably steel, in order to provide for a rigid and durable anchoring for the tilt locking device 20. The notch member 10 comprises a first row 12 of notches 13. The notches 13 may be arranged successively and thus form a comb element. The notches 13 may be shaped semi-circular, and thus be configured to securely accommodate a cylindrical element. The notch member 10 of the illustrated embodiment also comprises a second row 14 of notches. The first row 12 and second row 14 of notches 13 are arranged side-by-side and may be equidistant, i.e. they may have the same length and shape, but be displaced in parallel.

In an alternative embodiment (not illustrated), the notch member comprises at least one row of notches, and may also comprise only one row.

The notches 13 of the first 12 and second 14 rows may not be aligned, such that center axes (illustrated in FIG. 4) of the notches 13 of the first row 12 do not coincide with the center axes of the notches 13 of the second row 14. A notch member 10 comprising two rows 12, 14 that are not aligned may have a resolution that is twice as high compared to a notch member comprising only one row of notches. The notches of the first and second rows 12, 14 may be arranged alternately along the rows, such that the interval between the center of a notch 13 in the first row 12 and the center of a next notch in the second row 14 is constant.

The locking device 20 comprises a first rotatable locking member 23. The locking device 20 may also comprise a second rotatable locking member 24. The first and second rotatable locking members 23,24 are configured for interlocking with the notch member 10, and the rotatable locking members 23,24 are rotatable about a first axis A1. A1 is indicated in the exploded FIG. 3 at several locations. When the locking device 20 is assembled, the A1-axes indicated in FIG. 3 coincide. The first axis A1 may be the center of a locking member rod 25 secured to the housing 21 at e.g. distal ends, such that the rotatable locking members 23,24 are connected to and rotatable about the locking member rod 25. Alternatively, the rotatable locking members 23,24 may be rotatably supported directly to the housing 21 without a locking member rod 25.

As the first and second rotatable locking members 23,24 may be identical, the description of the rotatable locking members is primarily directed to the first rotatable locking member 23, but the features of the first rotatable locking member 23 may also be provided on the second rotatable locking member 24.

The first rotatable locking member 23 may be shaped such that it has two generally parallel sides 26. The parallel sides 26 may comprise a rotation opening 27 that may generally be an opening that extends through the two generally parallel sides 26, through which the locking member rod 25 may extend. The first rotatable locking member 23 may further comprise a lock element 28. The lock element 28 is configured for interconnection with the notches 13 of the first row of notches 12 of the notch member 10. Correspondingly, the second rotatable locking member 24 may comprise a lock element 29. The lock element 29 of the second rotatable locking member 24 is configured for interconnection with the notches 13 of the second row of notches 14 of the notch member 10. The lock element 28 may be a cylindrical element that extends between the two sides 26 of the first rotatable locking member 23, and the lock element 28 may be e.g. a steel rod, etc.

The first rotatable locking member 23 is biased in a first direction D5 about the first axis A1. In the illustrated embodiment, an intermediate member 30 is positioned between and adjacent to the first and second rotatable locking members 23,24 along the first axis A1. The intermediate member 30 biases the first and second rotatable locking members 23,24 in the first direction D5. The intermediate member 30 is also rotatable about the first axis A1, and may be rotatably connected to the locking member rod 25. The intermediate member 30 may comprise an intermediate member spring 31. The intermediate member spring 31 biases the intermediate member 30 which in turn exerts a biasing force to the first and second rotatable locking members 23,24 such that the rotatable locking members are biased in the first direction D5. The intermediate member 30 thus biases the first and second rotatable locking members 23,24 sufficiently to force the lock elements 28,29 out of a corresponding notch 13 when the locking device 20 is not in a locked position.

In the illustrated embodiment, the intermediate member spring 31 is partly housed in the intermediate member 30, and the intermediate member spring 31 is thus rotatably connected to the first axis A1 such that the force the intermediate member spring 31 exerts is about the first axis A1. The intermediate member spring 31 may be compressed between the housing 21 and the intermediate member 30. Alternatively, the first and second rotatable locking members 23,24 may be directly biased in the first direction D5 by a spring or similar means without an intermediate member 30.

The intermediate member 30 comprises an interconnection pin 32. The interconnection pin 32 may extend on both sides of the intermediate member 30 and protrude into corresponding locking member recesses or openings 33,34 of the first and second rotatable locking members 23,24, respectively. Rotation of the intermediate member 30 due to the biasing force of the intermediate member spring 31 is thereby transferred to the first and second rotatable locking members 23,24. The locking member openings 33,34 may preferably be larger than the interconnection pin 32 such that the first and second rotatable locking members 23,24 may rotate independently of the intermediate member 30 an amount determined by the relative size of the interconnection pin 32 and locking member openings 33,34. The locking member openings 33,34 may also be oblong or grooves, in which case the allowed, independent rotation of the first and second rotatable locking members 23,24 is determined by the length of the grooves. The first and second rotatable locking members 23,24 may as such also rotate about axis A1 independently of each other.

When the first and second rotatable locking members 23,24 are biased in the first direction D5, the lock elements 28,29 are thus biased away from the notches 13 of the first and second row of notches 12,14 and the locking device 20 is in an open state and a chair seat may be tilted up or down.

In an alternative embodiment (not illustrated), a locking device comprises only one rotatable locking member, and there is therefore no need for an intermediate member. The rotatable locking member may in this embodiment be biased directly by a spring. The notch member may in this embodiment also comprise only one row of notches.

A rotatable activation member 35 is rotatable about a second axis A2. The second axis A2 is generally parallel to the first axis A1, and A1 and A2 may also be coplanar as in the illustrated embodiment. A2 is indicated in the exploded FIG. 3 at several locations. When the locking device 20 is assembled, the A2-axes indicated in FIG. 3 coincide. The second axis A2 may be the center of an activation member rod 36 secured to the housing 21 at e.g. distal ends, such that the rotatable activation member 35 is connected to and rotatable about the activation member rod 36. Alternatively, the rotatable activation member 35 may be rotatably supported directly to the housing 21 without an activation member rod 36.

The rotatable activation member 35 may comprise an activation member spring 37. The rotatable activation member 35 is configured to abut and bias the first and second rotatable locking members 23,24 in a second direction D6 opposite the first direction D5 into interlocking with the notch member 10. The activation member spring 37 comprises two spring abut portions 38 that are configured to abut and exert a force on each corresponding rotatable locking member 23,24 at an abutment portion 39. The abutment portion 39 may even be provided with an abutment portion protection 40, that may be a plastic insert and prevents metal-to-metal contact if the activation member spring 37 and rotatable locking members 23,24 are all made from metal. The biasing force of the activation member spring 37 exceeds the biasing force of the intermediate member spring 31, such that when the rotatable activation member 35 is rotated in a first direction D7 about the second axis A2 into abutment with the rotatable locking members 23,24, the rotatable locking members 23,24 are rotated in the second direction D6 about the first axis A1.

In the illustrated embodiment, the activation member spring 37 is partly housed in the activation member 35, and the activation member spring 37 is thus rotatably connected to the second axis A2. The activation member spring 37 is configured to abut and rotate the rotatable locking members 23,24 in the second direction D6. The resilient nature of the activation member spring 37 enables one of the rotatable locking members 23,24 to be further rotated even though the other rotatable locking member is prevented from further rotation because it is not accommodated into a notch 13. If the lock element 28 of the first rotatable locking member 23 is accommodated and interlocked with a notch 13 of a first row 12 of notches, the lock element 29 of the second rotatable locking element 24 may not be accommodated into a notch 13 of the second row 14 of notches, because the center axes (illustrated in FIG. 4) of the notches 13 of the first row 12 may not coincide with the center axes of the notches 13 of the second row 14. This principle works for both rotatable locking elements 23,24; if the lock element 29 of the second rotatable locking member 24 is accommodated and interlocked with a notch 13 of a second row 14 of notches, the lock element 28 of the first rotatable locking element 23 may not be accommodated into a notch 13 of the first row 12 of notches. The activation member spring 37 allows for such selective interlocking. Which one of the two rotatable locking members 23,24 is interlocked with the notch member 10 depends on the vicinity of the lock elements 28,29 to a corresponding notch 13. In effect, a notch member 10 comprising two rows 12,14 of notches 13 arranged such that the center axes of the notches 13 of the first row 12 do not coincide with the center axes of the notches 13 of the second row 14 provides for adjusting of high resolution.

The rotatable activation member 35 may further comprise an activation groove 41. The activation groove 41 may be configured for accommodating the activation rod (described previously with reference to FIG. 2). The activation groove 41 may be shaped such that the rotatable activation member 35 is rotated in the first direction D7 about the second axis A2 as the activation rod is moved upwards in the activation groove 41. In FIG. 2, this corresponds to a downwards movement of the handle in the direction D3. This activation of the tilt locking device 20 is described in further detail with reference to FIGS. 6 and 7.

When the rotatable activation member 35 is rotated in a second direction D8 about the second axis A2, the rotatable activation member 35 and activation member spring 37 no longer biases the rotatable locking elements 23,24, and the intermediate member spring 31 thus forces the intermediate member 30 to rotate in the first direction D5 and force the rotatable locking elements 23,24 away from the notch member 10 and thus prevent interconnection between the rotatable locking elements 23,24 and the notch member 10.

The lock elements 28,29 may be allowed out of a notch 13 in combination with a predetermined position of the lock element 28,29 in the notch 13. Such a predetermined position may be in the middle of the notch 13, and this position may be achieved only if the rotatable locking members 23,24 are moved up or down somewhat, in addition to being unbiased by the rotatable activation member 35. Such an up or down movement may be due to a user tilting the seat somewhat. This eliminates a common problem of the seat unintentionally tilting due to e.g. the handle being accidentally moved to an open position, when the spring mechanism that biases the seat (described with reference to FIG. 1) forcefully tilts the seat.

In the alternative embodiment (not illustrated) comprising only one rotatable locking member, the rotatable locking member may be directly biased in the second direction by the rotatable activation member.

Figure 4:
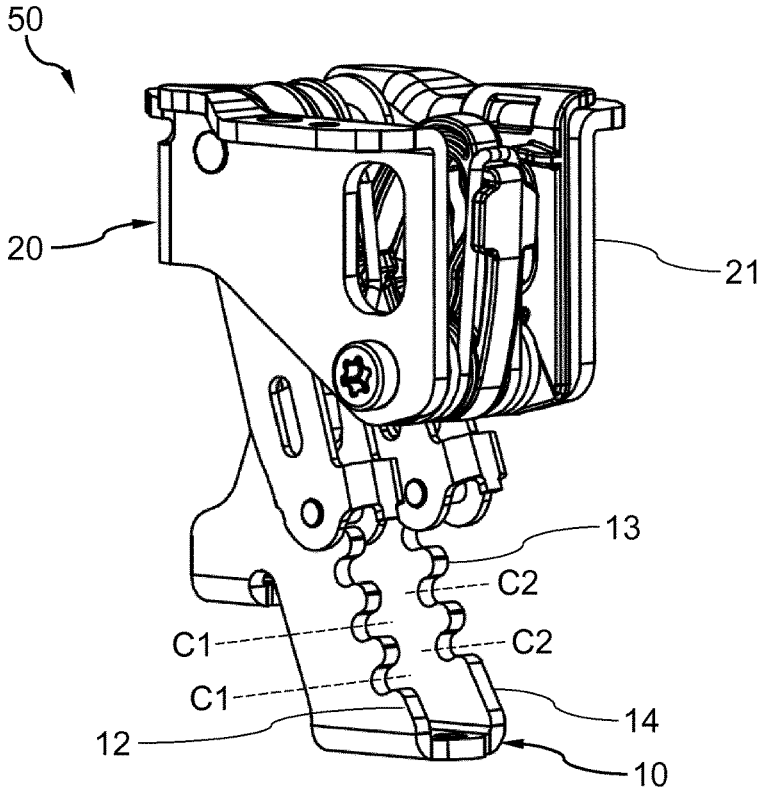
FIG. 4 is a perspective view of a tilt lock assembly comprising a tilt locking device and a notch member.

Referring now to FIG. 4, a tilt locking assembly 50 is illustrated. The tilt locking assembly 50 comprises a tilt locking device 20 and a notch member 10. The tilt locking device 20 is a very compact unit where most of the parts are positioned on the inside of the housing 21. The tilt locking device 20 is thus easy to handle and mount in e.g. a chair seat. As described with reference to FIG. 3, the notches 13 of the first row 12 and second row 14 of the notch member 10 may not be aligned. I.e. if center axes are drawn through the notches of the first and second row 12,14, as illustrated in FIG. 4, the center axes C1 of the notches 13 of the first row 12 do not coincide with the center axes C2 of the notches 13 of the second row 14.

Figure 5:
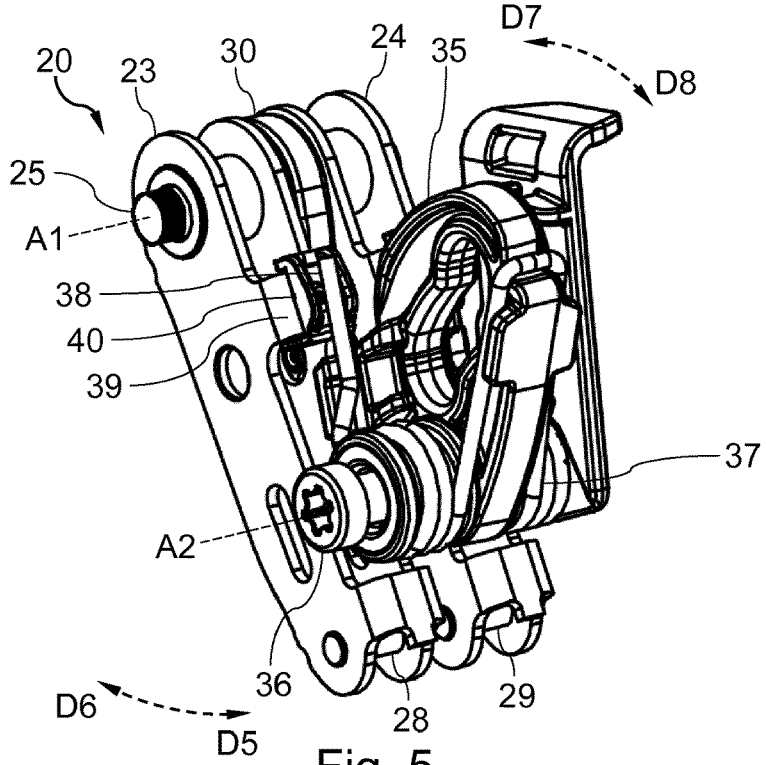
FIG. 5 is a perspective view of the tilt locking device where the housing is removed for visualizing purposes.

FIG. 5 illustrates tilt locking device 20 where the housing is removed for visualizing purposes. The first and second rotatable locking members 23,24 are arranged adjacent the intermediate member 30, the first and second rotatable locking members 23,24 and intermediate member 30 being rotatable about the first axis A1. In the illustrated embodiment the first rotatable axis A1 is the center of the locking member rod 25. The intermediate member 30 biases the first and second rotatable locking members 23,24 in the first direction D5 about the first axis A1, as explained with reference to FIG. 3.

The activation member 35 is rotatable about the second axis A2. In the illustrated embodiment the second rotatable axis A2 is the center of the activation member rod 36. The activation member 35 may comprise the activation member spring 37, and upon activation, the activation member 35 is rotated in a first direction D7 about the second axis A2. Upon rotation in the first D7 direction, the spring abut portions 38 of the activation member spring 37 abut the abutment portions 39 of the first and second rotatable locking members 23,24. The abutment portions 39 may comprise abutment portion protection 40. The first and second rotatable locking members 23,24 are thus rotated in a second direction D6 about the first axis A1 until either the lock element 28 of the first rotatable locking member 23 is accommodated and interlocked with a notch of a first row of notches, or the lock element 29 of the second rotatable locking member 24 is accommodated and interlocked with a notch of a second row of notches.

Figure 6:
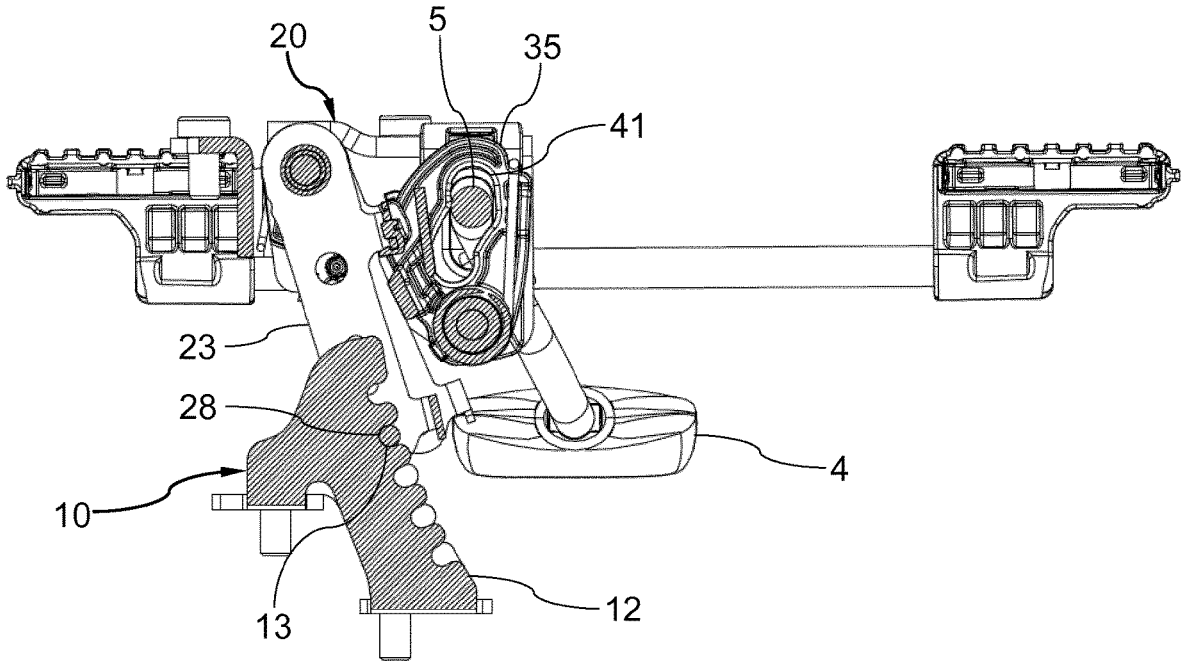
FIG. 6 is a section view of the tilt locking device in a locking position.
Figure 7:
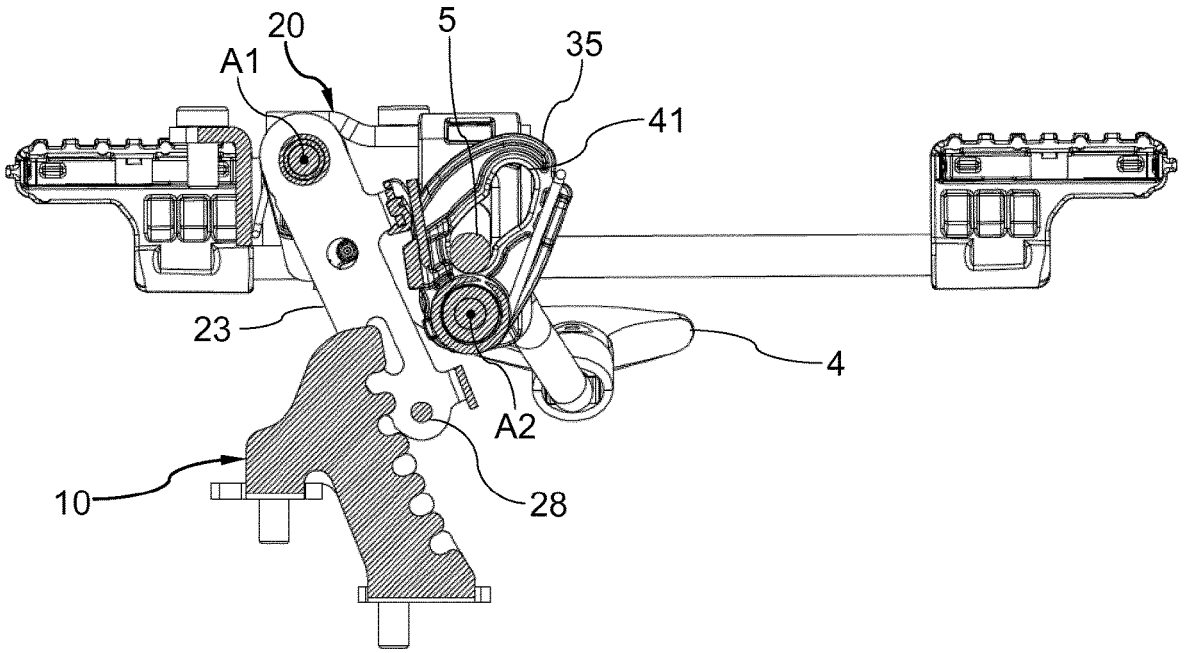
FIG. 7 is a section view of the tilt locking device in an open position.

FIGS. 6 and 7 are section views of the tilt locking device 20, notch member 10, and activation rod 5. In FIG. 6, the handle 4 is in a lower position, and the activation rod 5 is in an upper position. A portion of the activation rod 5 is in the activation groove 41 of the rotatable activation member 35, and the tilt locking device 20 is in a locking position where e.g. the first rotatable locking member 23 has been rotated into interlocking with the notch member 10. The lock element 28 of the first rotatable locking member 23 is in this locking position accommodated and interlocked with a notch 13 of the first row 12 of notches.

In FIG. 7, the handle 4 has been moved to an upper position, and the activation rod 5 is in a lower position in the activation groove 41 of the rotatable activation member 35. The rotatable activation member 35 has in FIG. 7 been rotated in a direction with the clock about the second axis A2 (indicated as a dot). The tilt locking device 20 is thus in an open position where the first and second rotatable locking members 23,24 have been rotated away from interlocking with the notch member 10, i.e. in FIG. 7 the first and second rotatable locking members 23,24 have been rotated in a direction against the clock about the first axis A2 (indicated as a dot). The locking device 20 (and e.g. a seat connected thereto) can thus be tilted or moved up and down relative to the notch member 10 because none of the lock elements (of which only lock element 28 is visible in FIG. 7) interlocks with the notch member 10.

While the invention has been described with reference to the embodiment(s) mentioned above, it is to be understood that modifications and variations can be made without departing from the scope of the present invention, and such modifications and variations shall remain within the field and scope of the invention.

The invention claimed is:

1. A tilt locking device for a chair, comprising a housing configured for connection to one of a seat and a frame; characterized by a first rotatable locking member, rotatable about a first axis and biased in a first direction about the first axis in a direction away from a notch member, the first rotatable locking member is configured for interlocking with the notch member;

a second rotatable locking member rotatable about the first axis independently of the first rotatable locking member and biased in the first direction about the first axis;

an intermediate member biasing the first and second rotatable locking members in the first direction, the intermediate member is biased in the first direction by an intermediate member spring;

a rotatable activation member rotatable about a second axis, the rotatable activation member is configured to abut and rotate the first and second rotatable locking members in a second direction opposite the first direction into interlocking one of the first and second rotatable locking members with the notch member;

the rotatable activation member comprises an activation member spring comprising two spring abut portions that are configured to abut and exert a force on each corresponding rotatable locking member at an abutment portion for resiliently abutting and rotating the first and second locking members, the biasing force of the activation member spring exceeds the biasing force of the intermediate member spring such that when the rotatable activation member is rotated in a first direction about the second axis into abutment with the rotatable locking members, the rotatable locking members are rotated in the second direction about the first axis.

2. The tilt locking device of claim 1, wherein the first and second rotatable locking members are connected by the intermediate member rotatable about the first axis and limiting individual rotation of the first and second rotatable locking members.

3. The tilt locking device of claim 1, wherein the first and second axes are rods connected to the housing.

4. The tilt locking device of claim 1, wherein the rotatable activation member is controlled by an activation rod.

5. The tilt locking device of claim 1, wherein the rotatable activation member comprises an activation groove configured for accommodating an activation rod.

6. The tilt locking device of claim 1, wherein the first and second rotatable locking members comprise a lock element for interconnection with a notch of the notch member.

7. A tilt locking assembly for a chair, comprising:

a tilt locking device comprising:

a housing configured for connection to one of a seat and a frame; characterized by a first rotatable locking member rotatable about a first axis and biased in a first direction about the first axis in a direction away from a notch member, the first rotatable locking member configured for interlocking with the notch member;

a second rotatable locking member rotatable about the first axis independently of the first rotatable locking member and biased in the first direction about the first axis;

an intermediate member biasing the first and second rotatable locking members in the first direction, the intermediate member biased in the first direction by an intermediate member spring; and a rotatable activation member rotatable about a second axis, the rotatable activation member configured to abut and rotate the first and second rotatable locking members in a second direction opposite the first direction into interlocking one of the first and second rotatable locking members with the notch member;

wherein the rotatable activation member comprises an activation member spring comprising two spring abut portions that are configured to abut and exert a force on each corresponding rotatable locking member at an abutment portion for resiliently abutting and rotating the first and second locking members, the biasing force of the activation member spring exceeds the biasing force of the intermediate member spring such that when the rotatable activation member is rotated in a first direction about the second axis into abutment with the rotatable locking members, the rotatable locking members are rotated in the second direction about the first axis; and a notch member configured for connection to one of a seat and a frame of a chair, comprising a first row and a second row of notches arranged side-by-side.

8. The tilt locking assembly according to claim 7, where the first and second row of notches are arranged equidistant.

9. The tilt locking assembly according to claim 7, wherein the notches of the first and second row are not aligned.

10. The tilt locking assembly according to claim 7, wherein the notches of the first and second row are arranged alternately along the rows.

11. The tilt locking assembly of claim 10, where the tilt locking assembly is controlled by a handle connected to an activation rod.

* * * * *